US006614349B1

(12) United States Patent
Proctor et al.

(10) Patent No.: US 6,614,349 B1
(45) Date of Patent: Sep. 2, 2003

(54) FACILITY AND METHOD FOR TRACKING PHYSICAL ASSETS

(75) Inventors: Rod L. Proctor, Seattle, WA (US); Andrew J. Rimkus, Bainbridge Island, WA (US)

(73) Assignee: Airbiquity Inc., Bainbridge Island, WA (US)

( * ) Notice: Subject to any disclaimer, the term of this patent is extended or adjusted under 35 U.S.C. 154(b) by 186 days.

(21) Appl. No.: 09/677,486

(22) Filed: Oct. 2, 2000

Related U.S. Application Data

(60) Provisional application No. 60/168,901, filed on Dec. 3, 1999.

(51) Int. Cl.[7] ..... G08B 13/14

(52) U.S. Cl. ..... 340/572.1; 340/5.92; 340/539; 340/825.49

(58) Field of Search ..... 340/568.1, 572.1, 340/539, 505, 825.49, 3.51, 5.92, 5.2, 10.1, 10.5; 705/28; 235/385

(56) References Cited

U.S. PATENT DOCUMENTS

| | | | | |
|---|---|---|---|---|
| 4,494,114 A | | 1/1985 | Kaish | 340/825.31 |
| 4,539,557 A | | 9/1985 | Redshaw | 340/539 |
| 4,598,272 A | | 7/1986 | Cox | 340/539 |
| 4,656,463 A | * | 4/1987 | Anders et al. | 340/572.1 |
| 4,675,656 A | * | 6/1987 | Narcisse | 340/539 |
| 4,750,197 A | | 6/1988 | Denekamp et al. | 379/58 |
| 4,918,425 A | | 4/1990 | Greenberg et al. | 340/539 |
| 4,918,717 A | | 4/1990 | Bissonnette et al. | 379/40 |
| 5,134,644 A | * | 7/1992 | Garton et al. | 340/539 X |
| 5,227,776 A | | 7/1993 | Starefoss | 340/825.36 |
| 5,289,372 A | | 2/1994 | Guthrie et al. | 364/403 |
| 5,301,353 A | * | 4/1994 | Borras et al. | 340/539 X |
| 5,317,309 A | | 5/1994 | Vercellotti et al. | 340/825.54 |
| 5,381,129 A | | 1/1995 | Boardman | 340/573 |
| 5,461,390 A | | 10/1995 | Hoshen | 342/419 |
| 5,497,149 A | | 3/1996 | Fast | 340/988 |
| 5,528,232 A | | 6/1996 | Verma et al. | 340/825.54 |
| 5,550,551 A | | 8/1996 | Alesio | 342/457 |
| 5,565,858 A | | 10/1996 | Guthrie | 340/10.33 |
| 5,594,425 A | | 1/1997 | Ladner et al. | |

(List continued on next page.)

OTHER PUBLICATIONS

Brian W. Martin, "WatchIt: A Fully Supervised Identification, Location and Tracking System," Proceedings of the IEEE, 29th Annual 1995 International Carnahan Conference on Security Technology, Oct. 1995.

PCT International Search Report dated Jun. 24, 2002, for International Application No. PCT/US02/00996.

Janus Technologies, Inc., "ProxTrak Asset Tracking Interface," copyright 2000 Janus Technologies, Inc., published on the Internet at *http://janus-tech.com/Products/ProxTrax.html*, printed May 29, 2002.

(List continued on next page.)

*Primary Examiner*—Thomas Mullen
(74) *Attorney, Agent, or Firm*—Stoel Rives LLP

(57) ABSTRACT

A communication module for an asset to be monitored operates to periodically receive a signal from a monitoring facility via a first wireless communication system, and in response to the absence of the signal at an expected time, communicating with the module via a second wireless system. The first system may be a short range system operating inside a limited facility, and the second system may be a cellular phone system. The module may include a global positioning receiver, so that the module may report its location via the second system to the monitoring system when it is taken from the transmission range of the first system.

17 Claims, 2 Drawing Sheets

U.S. PATENT DOCUMENTS

| | | | | | |
|---|---|---|---|---|---|
| 5,621,388 | A | * | 4/1997 | Sherburne et al. | 340/568.1 X |
| 5,627,517 | A | | 5/1997 | Theimer et al. | 340/572.1 |
| 5,650,770 | A | | 7/1997 | Schlager et al. | 340/573 |
| 5,691,980 | A | * | 11/1997 | Welles, II et al. | 370/316 |
| 5,731,757 | A | | 3/1998 | Layson, Jr. | 340/573 |
| 5,742,233 | A | | 4/1998 | Hoffman et al. | |
| 5,748,083 | A | | 5/1998 | Rietkerk | 340/568 |
| 5,748,084 | A | | 5/1998 | Isikoff | 340/568 |
| 5,751,246 | A | | 5/1998 | Hertel | 342/357 |
| 5,774,876 | A | | 6/1998 | Wooley et al. | |
| 5,804,810 | A | | 9/1998 | Wooley et al. | |
| 5,815,114 | A | | 9/1998 | Speasl et al. | |
| 5,825,283 | A | | 10/1998 | Camhi | 340/438 |
| 5,838,237 | A | | 11/1998 | Revell et al. | |
| 5,886,634 | A | * | 3/1999 | Muhme | 340/572.1 |
| 5,892,441 | A | | 4/1999 | Wooley et al. | |
| 5,892,454 | A | | 4/1999 | Schipper et al. | |
| 5,936,526 | A | | 8/1999 | Klein | 340/571 |
| 5,949,335 | A | | 9/1999 | Maynard | 340/572.1 |
| 5,963,134 | A | | 10/1999 | Bowers et al. | 340/572.1 |
| 6,002,363 | A | | 12/1999 | Krasner | |
| 6,011,973 | A | | 1/2000 | Valentine et al. | 455/456 |
| 6,024,142 | A | | 2/2000 | Bates | 141/94 |
| 6,032,037 | A | | 2/2000 | Jeffers | 455/404 |
| 6,057,756 | A | | 5/2000 | Engellenner | 340/505 |
| 6,067,044 | A | | 5/2000 | Whelan et al. | 342/357.07 |
| 6,069,570 | A | | 5/2000 | Herring | |
| 6,075,458 | A | | 6/2000 | Ladner et al. | |
| 6,076,099 | A | | 6/2000 | Chen et al. | 709/202 |
| 6,140,956 | A | | 10/2000 | Hillman et al. | 342/357.07 |
| 6,151,493 | A | | 11/2000 | Sasakura et al. | 455/421 |
| 6,166,688 | A | | 12/2000 | Cromer et al. | 342/357.17 |
| 6,175,307 | B1 | | 1/2001 | Peterson | 340/531 |
| 6,181,253 | B1 | | 1/2001 | Eschenbach et al. | 340/825.37 |
| 6,249,227 | B1 | | 6/2001 | Brady et al. | 340/572.1 |
| 6,266,008 | B1 | | 7/2001 | Huston et al. | 342/357.09 |
| 6,269,392 | B1 | | 7/2001 | Cotichini et al. | 709/200 |
| 6,272,315 | B1 | | 8/2001 | Chang et al. | 455/13.1 |
| 6,288,645 | B1 | | 9/2001 | McCall et al. | 340/568.2 |
| 6,295,461 | B1 | | 9/2001 | Palmer et al. | 455/557 |
| 6,300,863 | B1 | | 10/2001 | Cotichini et al. | 340/5.8 |
| 6,300,875 | B1 | | 10/2001 | Schafer | 340/573.1 |
| 6,304,186 | B1 | | 10/2001 | Rabanne et al. | 340/573.4 |
| 6,307,471 | B1 | | 10/2001 | Xydis | 340/568.1 |
| 6,362,736 | B1 | | 3/2002 | Gehlot | 340/568.1 |

OTHER PUBLICATIONS

Lockwood Technology Corporation, "Asset Management," copyright 2002 by Lockwood Technology Corporation, published on the Internet at *http://www.lockwoodtechnology-.com/asset_tracking.html*, printed May 29, 2002.

Thomas W. Christ, "A Prison Guard Duress Alarm Location System," Proceedings of the IEEE 1993 International Carnahan Conference on Security Technology: Security Technology, Oct. 13–15, 1993, Copyright 1993 IEEE.

Anton B. Reut, "Remote Monitoring of Military Assets Using Commercial Leo Satellites," IEEE Universal Communications Conference Record, Nov. 6–8, 1995, Copyright 1995 IEEE.

Jay Werb and Colin Lanzl, "Designing a Positioning System for Finding Things and People Indoors," *IEEE Spectrum*, Sep. 1998.

Jay Werb and Colin Lanzl, "The Next Generation of Control: Local Positioning," abstract, Feb. 1999, vol. 26.

R.E. Lavigne and P. Eng, "Trunking Versus Conventional Radio System," Proceedings of the IEEE, 34$^{th}$ Annual 2000 International Carnahan Conference on Security Technology, Oct. 23–25, 2000.

Alfonso Bilbao, m–Security (Security and Mobile Telephony), Proceedings of the IEEE 35$^{th}$ Annual 2001, International Carnahan Conference on Security Technology, Oct. 16–19, 2001.

Shawn McNichols, "Keeping Your Assets Safe," published on the Internet at http://www.*securitymagazine.com,CDA/ArticleInformation/features/BNP_Features*, posted Feb. 14, 2002, Copyright 2001–2002 by Business News Publishing Co.

"Tracking," published on the Internet at *http://www.wise-track.com/tracking.html*, posted May 29, 2002, Copyright 2001 by TVL, Inc.

* cited by examiner

FACILITY AND METHOD FOR TRACKING PHYSICAL ASSETS

REFERENCE TO RELATED APPLICATION

This is a non-provisional application based on provisional application No. 60/168,901, filed Dec. 3, 1999.

FIELD OF THE INVENTION

The present invention is directed to wireless communication, and more particularly to asset location and tracking systems.

BACKGROUND AND SUMMARY OF THE INVENTION

Businesses have an ongoing need to track and inventory assets. This is particularly critical for high-value assets such as in portable communications test equipment used by the telecommunications industry. When valuable equipment is portable, it is susceptible to theft, as well as loss or misplacement. Because such equipment may be used at remote locations outside the premises of the business, conventional security measures such as locking down equipment and guarding against its removal are impractical.

In addition, even where security is not a concern, equipment may be misplaced and not locatable when needed, even if safely stored on the proper premises, leading to increased equipment costs to ensure an adequate inventory. Also, some equipment may include specialized hardware and software that may have different versions, different update status, and different compatibility for different uses. It may be difficult for an inventory system to monitor the particular characteristics of each item, so that the most appropriate item can be located, or so that deficient items can be efficiently located for updating.

Systems have been proposed to track assets using global positioning system (GPS) signals, with cellular transceivers reporting the assets' locations. While possibly suited for some applications, these are not useful for areas where GPS signals do not reach, such as the interior of most buildings where many types of assets are most likely to be found.

The present invention overcomes the limitations of the prior art by providing a communication module for an asset to be monitored. The module operates to periodically a signal from a monitoring facility via a first wireless communication system, and in response to the absence of the signal at an expected time, communicating with the module via a second wireless system. The first system may be a short range system operating inside a limited facility, and the second system may be a cellular phone system. The module may include a global positioning receiver, so that the module may report its location via the second system to the monitoring system when it is taken from the transmission range of the first system.

DETAILED DESCRIPTION OF A PREFERRED EMBODIMENT

Figure 1:
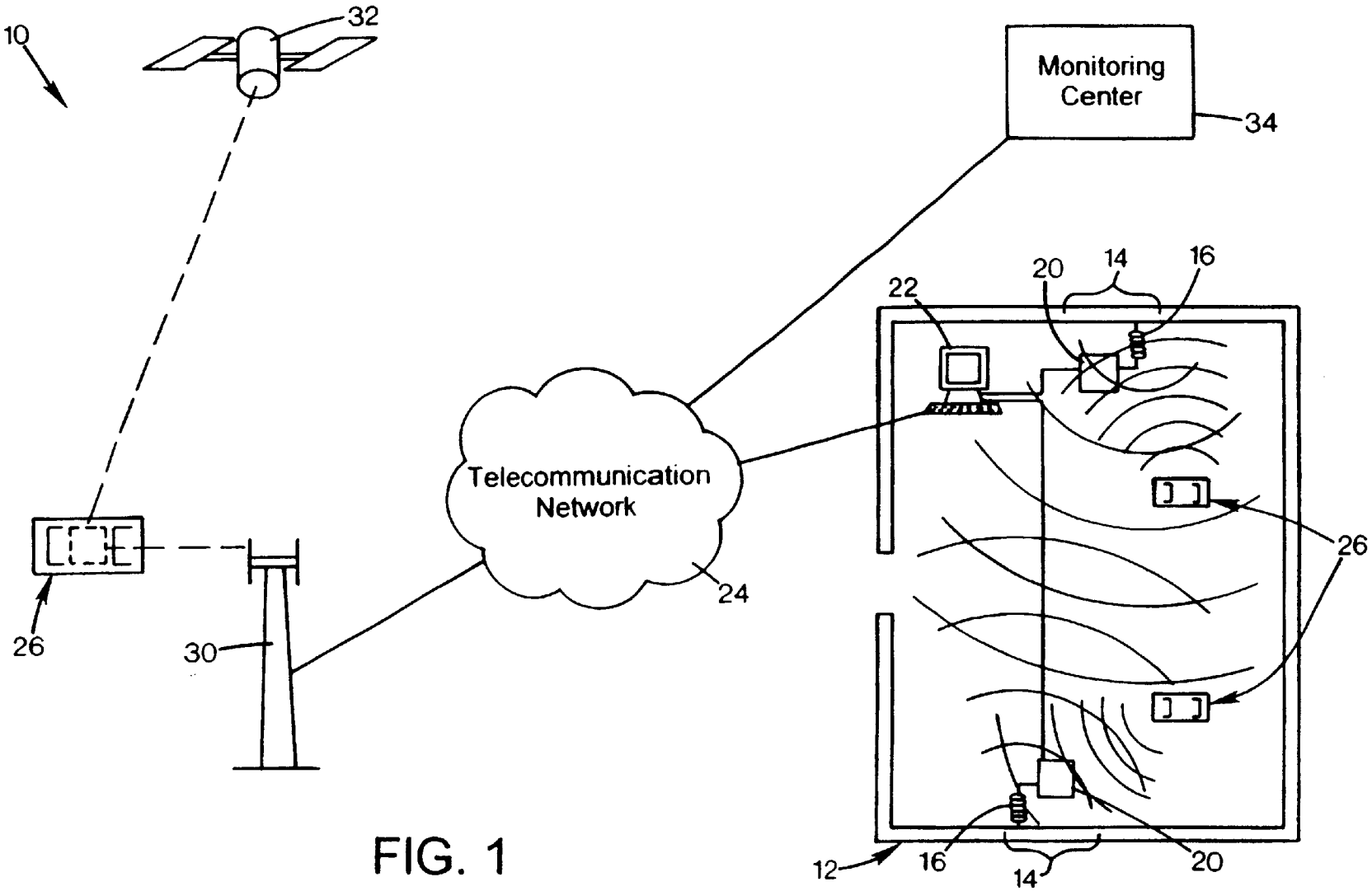
FIG. 1 is a high-level block diagram showing the environment in which the facility preferably operates.

FIG. 1 shows an asset tracking system 10 operating both internally to and externally of a user entity's physical facility

12. The facility may be one or more buildings, such as warehouses, or open areas in a limited space, normally private or restricted property controlled by the user. The facility contains a short range wireless communication system having one or more base transceiver stations 14 that are installed in the facility in sufficient numbers and distributed locations to provide full wireless communication coverage for the entire interior of the facility.

Each base station 14 includes a transceiver and antenna 16, and a controller 20. The controllers are connected to a central computer 22 in the facility, or connected to the components in the facility. The computer 22 is connected to a telecommunication network 24, such as provided by the Internet, an internal network, or a public switched telephone network. A number of equipment assets 26 to be tracked may be located anywhere, inside of or outside of the facility. As will be discussed below, each of these assets includes a communication module that communicates with the facility transceivers 14, with a cellular network 30 connected to the telecommunication network, and with a satellite-based global position system (GPS) 32. A center 34 connected to the network 26 receives and coordinates communications from the asset modules.

The facility's internal wireless communication system is preferably a radio frequency system operating on a 2.4 GHz ISM (Industrial, Scientific, Medical) frequency band designated by the FCC as a license-free band. This provides broadcast and reception range of about 1000 feet, so that larger facilities may require more than one base station. An advantage of this mode is that the low power spread spectrum transceivers do not affect nearby equipment that might otherwise be susceptible to radio frequency energy generated in other modes, such as by cellular transmitters. Depending on the configuration of the facility, more base stations may be required if the space is subdivided into rooms by walls that impede transmission of signals. In alternative embodiments, different frequency bands may be employed. For applications in which the assets are large and generally visible in an open space, visible or infrared line-of-sight transmissions may be used. Such a system is better suited for tracking large equipment such as heavy machinery or large manufactured goods than for the smaller portable electronic assets of the preferred embodiment.

Figure 2:
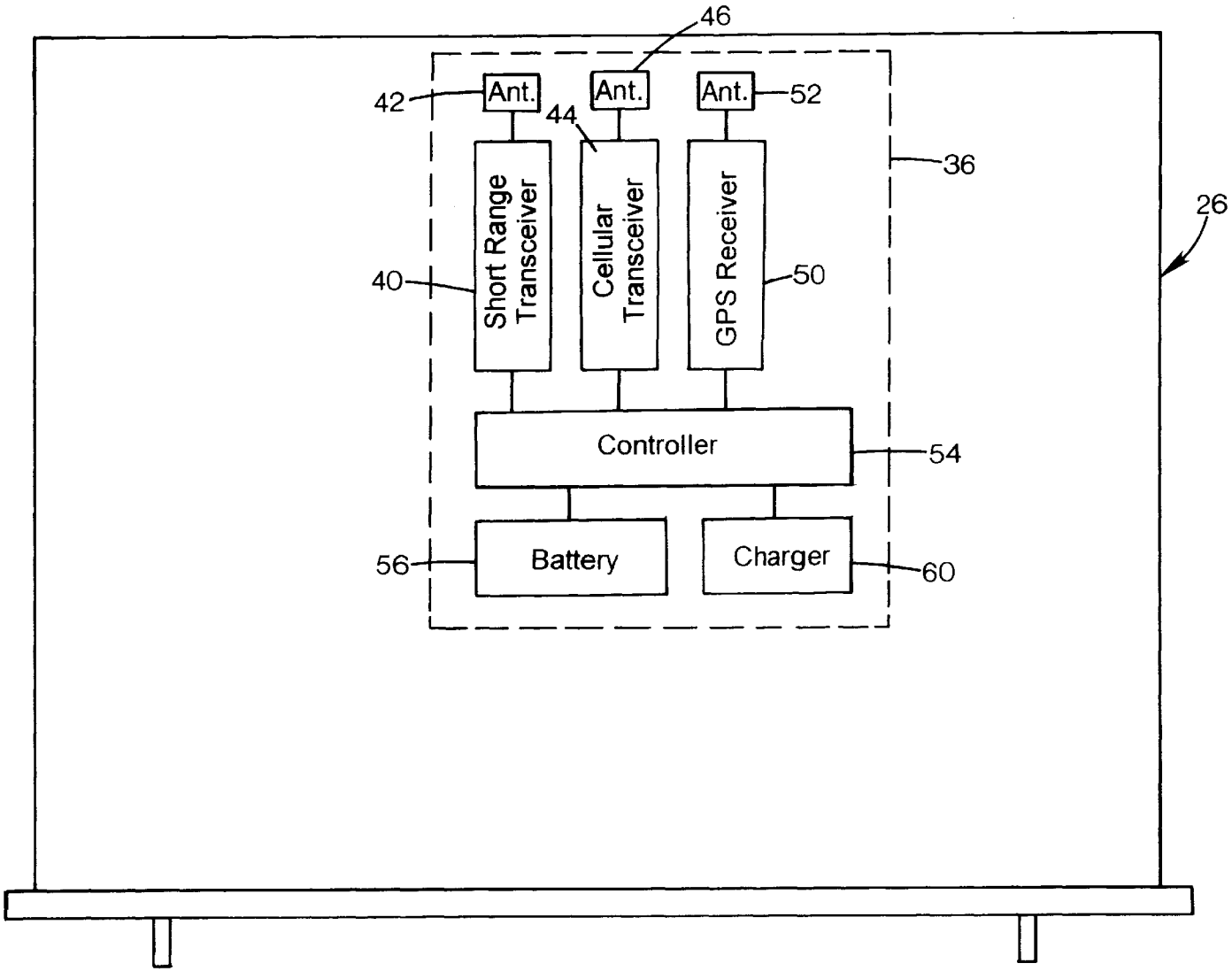
FIG. 2 is a schematic block diagram showing an instrument tracking module according to a preferred embodiment of the invention.

FIG. 2 shows a portable electronic equipment asset 26, which includes a tracking communication module 36. The module includes a short range transceiver 40 and associated antenna 42 that communicate with the facility base stations 14 when the asset is in the facility. A cellular transceiver 44 and associated cellular antenna 46 operate to communicate with the cellular system 30 when the asset is outside of the facility. A GPS receiver 50 and associated antenna 52 operate to receive signals from satellites 32, from which the receiver calculates its location.

A controller 54 includes microprocessor circuitry programmed to coordinate communication by each of the above elements, and may be integrated with or connected to other circuitry in the asset. Such integration may be used so that the controller disables or enables the asset function depending on communication status (e.g. disabling the device if taken out of an authorized area by a presumed thief.) The controller may also read information from the device, including asset configuration, identifying number, asset options, software revision level, and hardware revision level, so that one of the transceivers can report this information to the central system. This permits the system to generate benefits other than security and inventorying. For instance, calibration and updates may be scheduled, either centrally, or by a report generated in the asset that a calibration or update is due.

The module includes a dedicated rechargeable battery 56 that powers the module when the asset is disconnected from an external power source. A charger 60 is connected to the device power supply to charge the battery when the device is connected to power for normal operation.

In the preferred embodiment, the short range transceiver 40 includes a 2.4 GHz modem. The cellular transceiver 44 may essentially consist of CDMA, TDMA, GSM or AMPS cellular telephone circuitry, with an analog modem converting digital signals to and from the controller into analog signals transmissible via cellular transmission. The circuitry of the communication tracking module 36 is shown as having separate components for each function. However, the various functions may integrated onto fewer components to reduce size and cost. Further, the module components may be integrated with other circuitry of the asset, at least in part as a security measure against unauthorized disablement or removal of the tracking circuitry.

Operation

The facility central computer 22 operates to regularly poll all assets in the facility to verify their presence. A polling signal is sent out to each of the assets, which reply with identifying information. Alternatively, the system may send out a single call for reports from the assets, which may reply sequentially or simultaneously. The reply may also include location information enabling the asset to be located within the facility, as well as other device status information noted above. Different devices may be polled at different selected intervals, and polling may be conducted automatically, or manually, such as in response to a user's need for a particular type of asset.

Each asset may operate using receipt of the polling signal as an optional "keep alive" signal, so that the asset is disabled if it does not receive the signal. Thus, a device that has been taken from the facility is disabled until it is returned. For devices requiring authorized use outside the facility, an authorization code may be entered to permit operation (this may be integrated with verification measures associated with remote cellular communication discussed below.)

If an asset is removed from the facility so that it is out of communication with the short range wireless system, it may be programmed to respond in several different ways, which may be employed separately or in combination. As noted above, it may disable itself in the absence of a "keep alive" signal.

Preferably, upon removal from the facility, the module responds to the lack of an expected polling signal at a selected time by initiating a cellular telephone transmission to the monitoring center. The call may be delayed any amount of time as needed. For some assets, an immediate call may be appropriate to prevent theft. For other assets routinely taken from the facility and normally returned within limited time period, a delay may be appropriate (e.g. a checked out municipal bus might not report its location until after the end of the expected shift, so that normal use does not trigger a cellular report, but failure to return promptly does.) The monitoring center may be a central agency serving many different independent users, or which may be on the site of the user, and connected directly to or integrated with the control computer 22.

Either automatically, or upon request by the monitoring authority, the module controller may activate the GPS circuitry to establish the current location of the asset, and transmit this location information to the monitoring center. This permits the asset to be recovered in the event of theft. In typical cases, such as when the asset has been removed as a part of routine business, the location may be checked against expected authorized locations. Such locations may be stored in a database to reflect corridors of authorized transport, remote locations of authorized use and storage, and trip or relocation plans entered in advance by personnel intending to make authorized transport.

As an alternative to the module automatically initiating cellular communication in the absence of the facility signal, the device may remain passive, so that action must be taken by the tracking computer. Essentially, the system calls the cellular transceiver of the missing asset to receive a report of its whereabouts. This has the disadvantage of requiring the cellular phone to be powered up in a receiving mode, depleting batteries. However, conservation measures such as cycling the receiver on only at periodic intervals known to the system limit power consumption.

In this case, the tracking computer is alerted by the absence of a response to the short range wireless signal in the facility. Consequently, the tracking system may take action to track down the asset. In cases where the asset is expected to be out of the facility for a pre-established period of time (such as if it is checked out for a temporary off-site job), the computer may take no action, unless the device does not return as expected. This strategy is suitable for users having multiple facilities between which assets are transported, where each facility has its own short range wireless tracking system. In such cases, the computer may allow a grace period for the device to return to a facility, before initiating cellular location efforts. These techniques are also applicable to the active module approach discussed above, in which the module initiates cellular communication in the absence of the facility signal.

Another operating mode provides a virtual "fence" within which the asset may tolerably be located, and outside of which it is not permitted to be moved. This fence may be preprogrammed into the controller as acceptable location values to be generated by the GPS unit. When GPS-generated location values depart from the acceptable domain, a cellular reporting call is initiated.

The module may include safeguards that disable the asset if it is kept out of cellular range for more than a selected period of time. For instance, to prevent a thief from secreting and using an asset in a shielded or remote area away from cellular coverage (assuming the absence of a keep-alive system), so that the owner could not locate it via the GPS/cellular link, the device may be programmed to become disabled. An extended grace period may be allowed, so that an authorized user may temporarily use the asset in a remote or shielded location. For extended use away from cellular coverage, a wired telephone line may be connected to the module to report location information, and to enable any keep-alive signals to be transmitted from the monitoring center.

Additional functionality may include using the wireless transport to provide software upgrades to the device; provide "data downloads" to the device that may update certain configuration information of the device. Other remote diagnostics could also take place during the connection to the wireless network.

While the above is discussed in terms of preferred and alternative embodiments, the invention is not intended to be so limited. For instance, instead of the two illustrated modes of communication (short range radio frequency and cellular frequencies), other communication modes may be used. These may include email, pager, satellite modes, in addition to other local transmission modes such as the optical modes discussed above. The modules may include other security features, such as motion, video and audio sensors that allow transmission of additional information about the environment into which the asset has been taken. Such information may be used to prosecute wrongdoers, and to deter future wrongdoing. Various combinations of the different features above may be employed without departing from the concept of the invention.

What is claimed is:

1. A method of monitoring an inventory of assets, each having a communication module, the method comprising:

providing a facility having a first wireless communication system operable to communicate with each module;

generating a first communication between the first system and each module;

based on the communication, establishing an inventory of assets in the facility;

based on the inventory, identifying a missing asset absent from the facility; and generating a second communication via a second communication system operating outside of the facility.

2. The method of claim 1 wherein the first wireless communication system has a range limited to the facility.

3. The method of claim 1 wherein establishing an inventory includes repeatedly communicating with the assets to update the inventory.

4. The method of claim 1 wherein generating a second communication includes communicating with the module of the missing asset via a cellular device in the module.

5. The method of claim 4 wherein the module includes a locator, and wherein generating a second communication includes transmitting the location of the device.

6. The method of claim 5 wherein the locator is a global positioning system device.

7. The method of claim 1 including causing the module of the missing asset to determine and report its location.

8. A method of monitoring an asset including a communication module, the method comprising:

periodically transmitting a signal to the module via a first wireless communication system;

in response to an absence of receiving the signal at an expected time, automatically operating the module to initiate a communication via a second wireless system; and wherein the step of periodically transmitting a signal includes transmitting a radio signal in a limited-area facility, and wherein the module is operable to detect removal from the facility by the absence of the signal.

9. A method of monitoring an asset including a communication module, the method comprising:

periodically transmitting a signal to the module via a first wireless communication system;

in response to an absence of receiving the signal at an expected time, automatically operating the module to initiate a communication via a second wireless system; and operating the module to transmit supplementary information in response to receipt of the signal.

10. The method of claim 9 wherein supplementary information includes at least a selected one of the set of information comprising: asset configuration, identifying number, asset options, software revision level, and hardware revision level.

11. A method of monitoring an asset including a communication module, the method comprising:

periodically transmitting a signal to the module via a first wireless communication system;

in response to an absence of receiving the signal at an expected time, automatically operating the module to initiate a communication via a second wireless system; and wherein the second wireless system is a cellular network.

12. A method of monitoring an asset including a communication module, the method comprising:

periodically transmitting a signal to the module via a first wireless communication system;

in response to an absence of receiving the signal at an expected time, automatically operating the module to initiate a communication via a second wireless system;

wherein initiating a communication via the second wireless system includes reporting the location of the asset; and receiving a global positioning system signal to establish the location of the asset.

13. A asset locator module comprising:

a first transceiver operable to communicate with a central inventory facility via a first wireless frequency;

a second transceiver operable to communicate with the central inventory facility via a second wireless frequency; and control circuitry operable to initiate communication via the second transceiver in response to a loss of communication via the first transceiver.

14. The apparatus of claim 13 wherein the first transceiver operates on a frequency having a limited transmission distance, such that removal from a facility having a transceiver operating on the frequency prevents communication.

15. The apparatus of claim 13 wherein the second transceiver is a cellular device.

16. The apparatus of claim 13 including locator circuitry.

17. The apparatus of claim 16 wherein the locator circuitry is a global positioning system device.

* * * * *